US006659777B1

(12) United States Patent
Rondeau

(10) Patent No.: US 6,659,777 B1
(45) Date of Patent: Dec. 9, 2003

(54) AUTOMOBILE ACTIVITY SCREEN

(76) Inventor: Tammy Rondeau, 920 15th St. Southwest, Naples, FL (US) 34117

( * ) Notice: Subject to any disclaimer, the term of this patent is extended or adjusted under 35 U.S.C. 154(b) by 445 days.

(21) Appl. No.: 09/655,350

(22) Filed: Sep. 5, 2000

(51) Int. Cl.[7] ..... B43L 1/08
(52) U.S. Cl. ..... 434/416; 434/419; 108/44
(58) Field of Search ..... 434/416, 419, 434/420, 428, 430, 431; 248/317, 323, 324, 284.1, 917; 108/44

(56) References Cited

U.S. PATENT DOCUMENTS 4,068,921 A * 1/1978 Okumura ..... 359/461
4,202,130 A 5/1980 Smith
4,545,768 A 10/1985 Hinnen
4,836,783 A 6/1989 Harper
4,846,434 A * 7/1989 Krogsrud ..... 248/284.1
4,865,380 A * 9/1989 Heitzman-Powell et al. ..... 297/184.13
4,897,066 A 1/1990 Tapdrup et al.
D342,170 S 12/1993 Palmer
5,460,102 A 10/1995 Pasmanick
5,467,853 A 11/1995 Pelletier
5,673,628 A * 10/1997 Boos ..... 108/44
D402,711 S 12/1998 Wrenn et al.
5,934,747 A 8/1999 Garland
6,132,283 A * 10/2000 O'Donnell et al. ..... 446/227
6,293,292 B1 * 9/2001 Watzke ..... 135/123

* cited by examiner

*Primary Examiner*—Kien T. Nguyen
(74) *Attorney, Agent, or Firm*—Michael I Kroll

(57) ABSTRACT

A child's automobile activity device is provided which rotatably attaches to an extension rod of the type that hooks on the garment hooks in the rear seat area. Several types of connection members are provided, that adjustably connect an activity screen to the extension rod such that the activity screen will be optimally positioned for viewing and access by the seated child. The activity screen, in one embodiment, includes a hinged chalkboard front portion that opens to form a horizontal eating or reading surface, as well as, providing access to a storage area behind the chalkboard. The activity screen positions a display of many varied and child oriented shapes, images, numbers, letters, games and the like for the child to view or utilize. Such display can be on the interior surface of the activity screen for access when the front portion is down or on the exposed surface of the front portion when the front portion is opened to its horizontal position. The display can also replace the chalkboard on the front portion exterior surface, providing access to the display when the front portion is in the closed and vertical position. In one embodiment a slide bar is attached to the activity screen, with spinners either slidably threaded onto the bar, or looped for spinning about the bar.

30 Claims, 12 Drawing Sheets

AUTOMOBILE ACTIVITY SCREEN

BACKGROUND OF THE INVENTION

1. Field of the Invention

The present invention relates generally to activity units and, more specifically, to automobile activity screens. The present invention, the automobile activity screen, is designed to occupy children while traveling in an automobile. The activity screen of the present invention is mounted to an extension rod, such as those having spring tension, that attaches to the garment hooks located in the rear seat area of an automobile. There will be various models, each enthralling to the age group designed to occupy. Each screen will provide intriguing elements such as colorful screens for newborns adjusting eyesight, learning games such as letters of the alphabet and numbers. There will be screens that will teach time and screens that will teach hand and eye coordination.

There is also a screen with a chalkboard for children to practice writing or drawing. The chalkboard model provides a fold down eating tray or book rest. The activity screens will ride on an extension rod that is attached to the garment hooks located in the rear seating area of an automobile. The screen holder attaches to an extension rod, having an opening into which the activity screen slides. The screen holder is attached to one end of a connection member, which is pivotally connected to the activity screen on the other end. At the top of the screen holder, is a wing nut that allows the user to adjust the positioning of the activity screen longitudinally and rotationally along the extension rod.

Located in close proximity to the wing nut is an angle adjustment knob, which allows the user to rotate the connection member, thereby rotating the activity screen. The child then can play games and will have the activity screen directly in front of them and at an appropriate distance. The screen can also be locked in various tilted positions for optimum viewing and access for children of any size.

These games are all one piece, so there are no pieces to be dropped on the floorboard of the vehicle or possibly swallowed by younger siblings.

The present invention allows parents to concentrate on the task of driving the vehicle without the occurrence of an extraneous interruption. To change screens, the user removes the extension rod hook from the extension rod and slides off the current screen. The desired screen is then slid onto the extension rod and the user reattaches the rod hook to the extension rod and the extension rod to the garment hook located in the rear seating area of the vehicle.

2. Description of the Prior Art

There are other activity device designed for mobile entertainment. Typical of these is U.S. Pat. No. 4,202,130 issued to Terry Smith on May 13, 1980. Another patent was issued to John Hinnen et. al. on Oct. 8, 1985 as U.S. Pat. No. 4,545,768. Yet another U.S. Pat. No. 4,836,783 was issued to Cliff Harper on Jun. 6, 1989 and still yet another was issued on Jan. 30, 1990 to Erik Tapdrup as U.S. Pat. No. 4,897,066.

Another patent was issued to Barbara Palmer on Dec. 14, 1993 as U.S. Pat. No. Des. 342,170. Yet another U.S. Pat. No. 5,460,102 was issued to Victoria Pasmanick on Oct. 24, 1995. Another was issued to Wendy Pelletier on Nov. 21, 1995 as U.S. Pat. No. 5,467,853 and still yet another was issued on Dec. 15, 1998 to David Wrenn et. al. as U.S. Pat. No. Des. 402,711.

U.S. Pat. No. 5,934,747 issued to Thomas A. Garland on Aug. 10, 1999.

U.S. Pat. No. 4,202,130

Inventor: Terry Smith

Issued: May 13, 1980

An amusement device for young children to be mounted on a safety belt in an automobile designed to occupy the child's attention during automobile trips, the device including knobs to be turned and buttons to be pushed The device includes lights, and a switch that will permit operation of the lights when the device is property mounted on the safety belt.

U.S. Pat. No. 4,545,768

Inventor John Hinnen

Issued: Oct. 8, 1985

An activity center includes a plurality of polygonal frames pivotally connected together Each frame includes an open area accessible from each side thereof and an activity device mounted therein whereby each device is accessible from either side of its respective frame. At least some of the activity devices are movable with respect to their respective frame. Particular elements of the activity center are interchangeable among the respective activity devices and the devices are generally cooperable with each other, thereby enhancing the usefulness of the apparatus.

U.S. Pat. No. 4,897,066

Inventor: Erik Tapdrup

Issued: Jan. 30, 1990

A toy activity center is provided with abase plate and a plurality of activity units to be received in holes in the base plate. The latter holes are defined by a silhouette plate whose edges are adapted to releasably receive the activity units, The units are formed with mechanical coupling means and the rear side of the base plate is provided with corresponding coupling projections so that the rear of the base plate may be used as a building base to which the activity units may be coupled.

U.S. Pat. No. 342,170

Inventor: Barbara Palmer

Issued: Dec. 14, 1993

The ornamental design for a child's car tray, as shown and described.

U.S. Pat. No. 5,460,102

Inventor: Victoria Pasmanick

Issued: Oct. 24, 1995

A portable work and play station particularly suited for a child traveling in an automobile or airplane is disclosed. A planar work surface is provided to which a clip for holding a work piece in place is attached. The work surface is supported by a deformable support bag, preferably filled with particulate materials so as to rest on a childs legs while in use. Covered rectangular storage wells for writing instruments are provided and circular wells for drinks are included. An interior storage volume is provided for paper and other apparatus as well as a hook holding device. Single piece and two piece folding configurations are disclosed.

U.S. Pat. No. 402,711

Inventor: David S. Wrenn

Issued: Dec. 15, 1998

This United States Patent discloses an ornamental design for a infant's activity center, as shown and described.

U.S. Pat. NO. 5,467,853

Inventor: Wendy Pelleticr

Issued: Nov. 21, 1995

A child's activity case opens up to form a desk that sits on a child's lap. The activity case can be filled with toys, coloring books, crayons, etc., to keep a child occupied during times that children have to keep siting such as in a car. The case comprises a flexible satchel made from fabric having aboard member in the base of the satchel. Opposing flaps are positioned on top of the satchel having zippers on either sides, the flaps overlap each other and have attachments to hold them together and retain the flaps closed. The flaps have inside pockets, and a carrying strap is provided to carry the case like a satchel.

U.S. Pat. No. 4.836,783

Inventor: Cliff Harper

Issued: Jun. 6,1989

An activity kit for drawing, painting, sewing or the like, comprising a rigid case providing a flat activity surface and a cavity within the case for receiving a roll of medium, such as paper on which the activity is to be carried out. Medium from the roll is fed between medium guide positioned on the activity surface adjacent in the direction of dispensing of the medium. A medium dispensing control may be provided to restrict the medium which can be pulled at one time to only so much as would cover the activity surface. The kit according to the present invention provides a portable, compact activity center for young children in which the wastage of medium, such as drawing paper may be minimized through use of the medium dispensing control.

U.S. Pat. No. 5,934,747

Inventor: Thomas A. Garland

Issued: Aug. 10 ,1999

A convertible activity center is convertible between a bouncer-type seat configuration and a play table configuration. The activity center includes a tray-shaped body portion having a planar play surface and a central opening therein, and a plurality of adjustable legs which are pivotally mounted to the body portion for supporting die body potion above a supporting surface. A seat assembly is removably mounted within the central opening to provide the bouncer-type seat configuration. The seat assembly is rotatable relative to the body portion for added play value. The leg assemblies are adjustable in height to provide different height settings as the child grows and further include an internal a spring arrangement which allows the body portion to resiliently bounce relative to the leg portions. A locking mechanism is provided for selectively locking out the bouncing feature. When the child reaches standing or walking stage of development, the bouncer can be converted into a table configuration by removing the seat assembly from the central opening and mounting an insert within the central opening to provide a substantially continuous play surface on the top of the body portion. In the table configuration, the bouncing feature would be locked out to provide a stable play surface, while the legs can be adjusted to different height levels depending on the needs of the particular child using the table.

While these activity devices may be suitable for the purposes for which they were designed, they would not be as suitable for the purposes of the present invention, as hereinafter described.

SUMMARY OF THE PRESENT INVENTION

A primary object of the present invention is to provide an amusement device for young children, designed to occupy the child's attention during automobile trips.

Another object of the present invention is to provide an automobile amusement device that attaches to the garment hooks located in the rear seat area of the vehicle.

Yet another object of the present invention is to provide a selection of various screens, designed to entertain different age groups, infants, toddlers, and children of all ages.

Still yet another object of the present invention is to provide an automobile amusement device that may be adjusted by sliding along an extension rod and may be adjusted by the user.

Another object of the present invention is to provide an automobile amusement device that rotates axially on an extension rod to swing the screen closer to or further from the child as necessary.

Still another object of the present invention is to provide an automobile amusement device having a screen that is pivotably attached to a connection member to allow the user to maintain the screen in a vertical position or to tilt the screen to a desired angle.

Yet another object of the present invention is to provide a one-piece automobile amusement device consisting of games and storage.

Additional objects of the present invention will appear as the description proceeds.

The present invention overcomes the shortcomings of the prior art by providing an automobile amusement device designed to entertain children during automobile trips, the device attaching to the vehicles garment hook, having various interchangeable screens, and being adjustable to suit the user.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which, FIG. 1 is a pictorial view depicting a child in her seat belt, having a snack at her automobile activity screen. The extension rod of the present invention is hooked to the garment hook and the screen is adjusted and positioned in a comfortable location at the child's discretion.

DESCRIPTION OF THE REFERENCED NUMERALS

Figure 1:
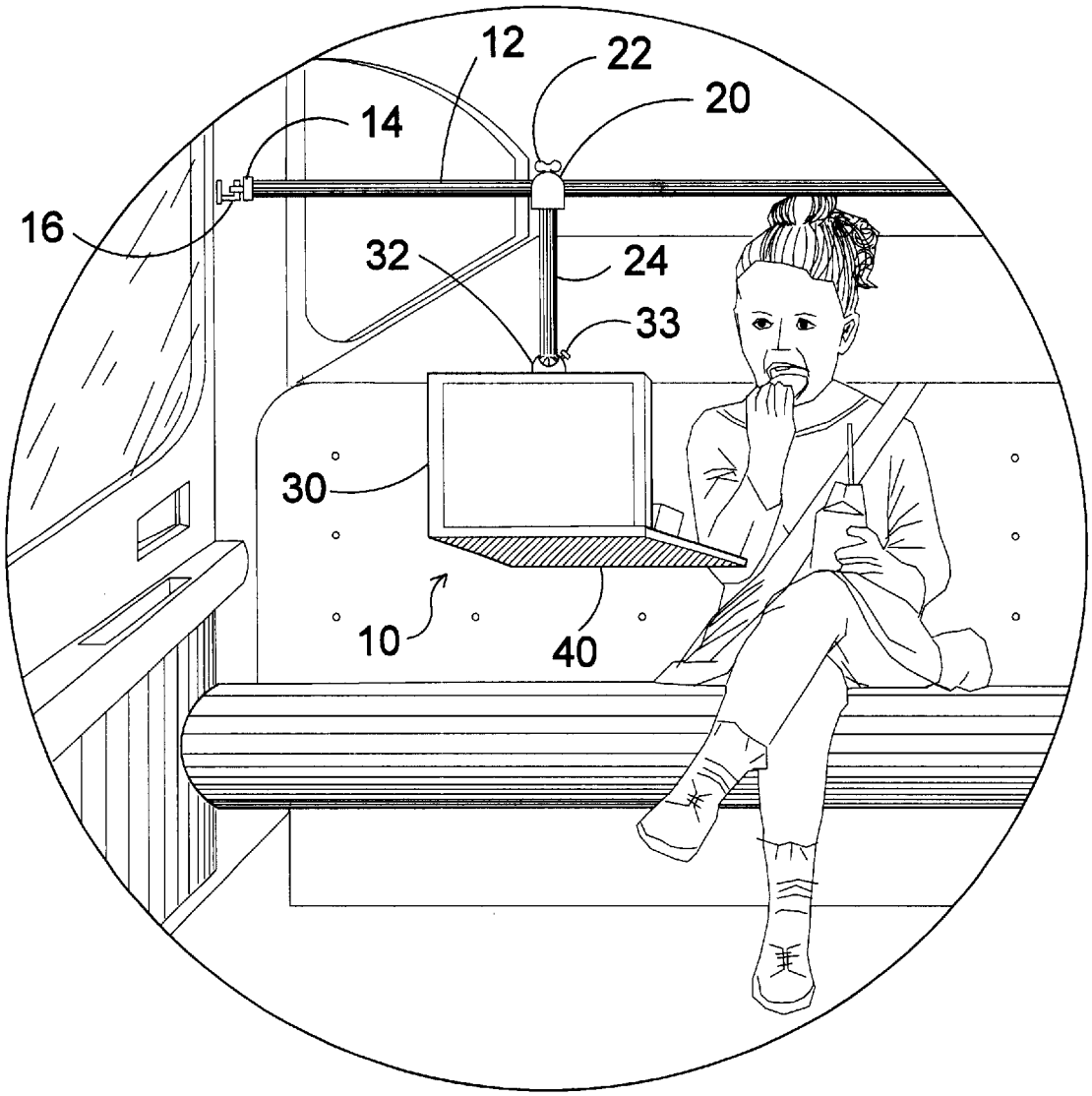

Turning now descriptively to the drawings, in which similar reference characters denote similar elements throughout the several views, the figures illustrate the Automobile Activity Screen of the present invention. With regard to the reference numerals used, the following numbering is used throughout the various drawing figures.

10 Automobile Activity Screen of the present invention
12 extension rod
14 rod hooks
16 garment hooks
20 screen holder
22 wing nut
24 connection member
26 angle adjustment screw
30 activity screen
32 pivoting ball joint
33 pivoting ball joint locking mechanism
34 telescoping connection member
35 telescoping connection member set screw
36 flexible connection member
40 front portion
41 front portion recess
42 front a portion hinge
44 plastic clips
46 tray stopper
47 front portion recess
48 chalkboard
50 eraser
52eraser string
54 chalk holder
56 chalk holder string
60 display
62 letters
64 numbers
66 mirror
68 slide bar
70 spinners with holes
72 spinners with loops
74 spinner loop

DETAILED DESCRIPTION OF THE PREFERRED EMBODIMENT

Turning now descriptively to the drawings, in which similar reference characters denote similar elements throughout the several views, FIGS. 1–12 illustrate the Automobile Activity Screen of the present invention indicated generally by the numeral 10.

The device 10 is shown in FIG. 1. As shown in Fig, the device 10 attaches to a typical extension rod 12, having rod hooks 14, the rod hooks 14 typically attaching to garment hooks 16.

Figure 5:
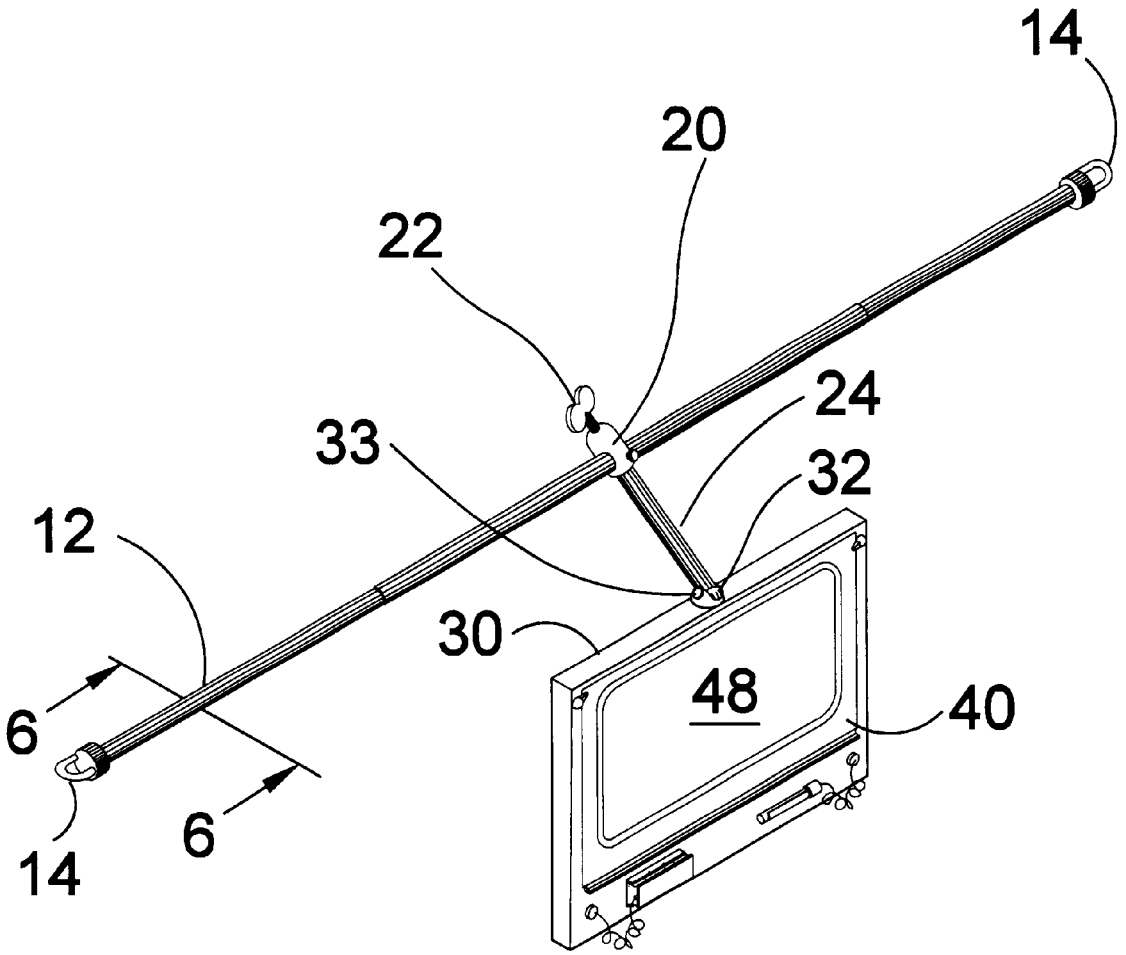
FIG. 5 is a perspective view of the present invention showing the screen holder rotated axially on the extension rod and secured in place by the wing nut, thereby angling the connection member to bring the screen closer to the child. The screen is maintaining it's vertical position due to the pivoting ball joint connection which can then be secured by the locking mechanism.
Figure 6:
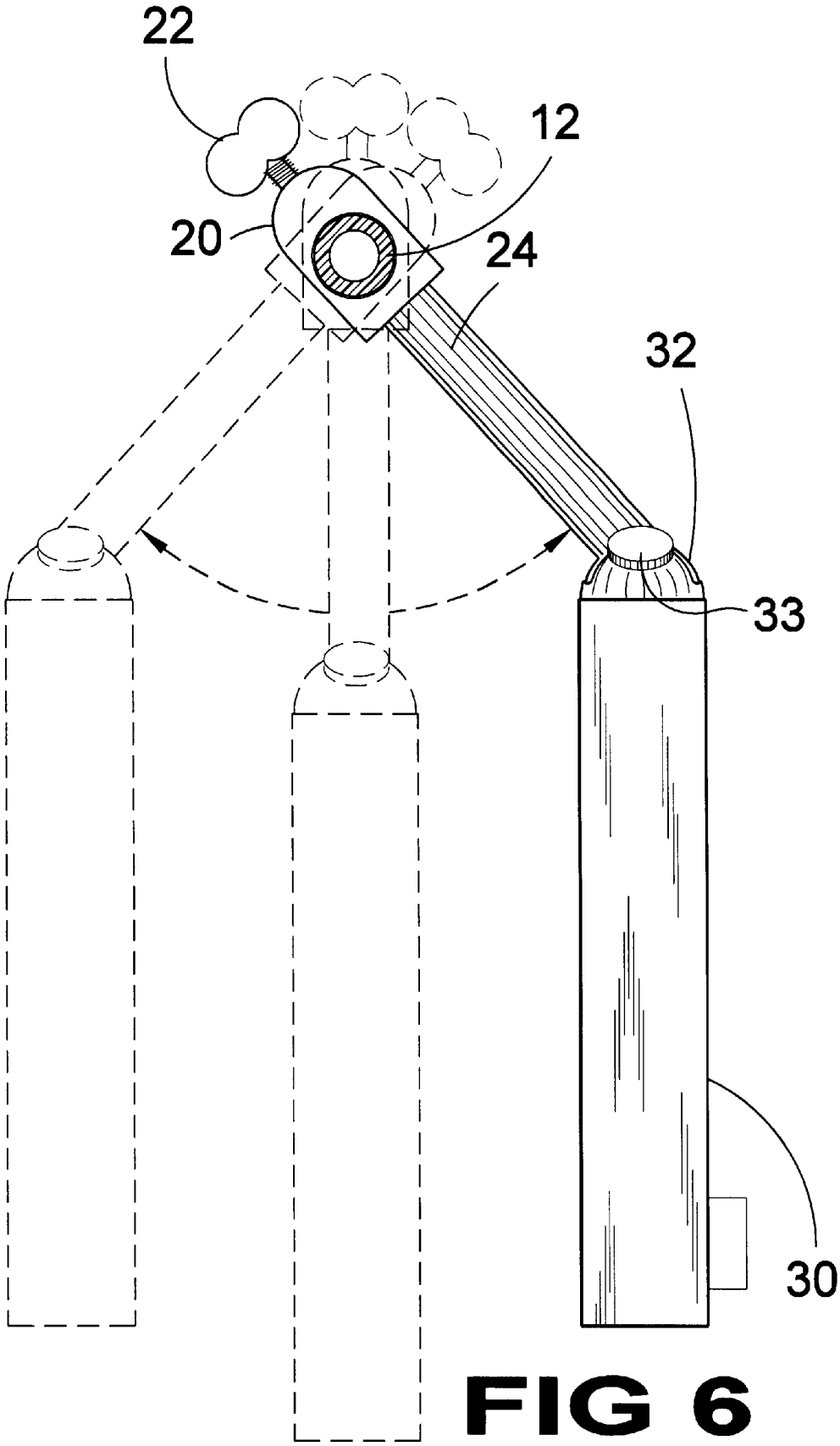
FIG. 6 is a side view of the present invention as indicated in FIG. 5 showing the screen holder rotated axially on the extension rod and secured in place by the wing nut thereby angling the connection member to bring the screen closer to the child. Two possible screen positions are shown in hidden line.

The device 10 includes a screen holder 20 that is rotatable about the extension rod 12 and fixed into position by wing nut 22. Such rotation is illustrated in FIGS. 5 and 6

Figure 3:
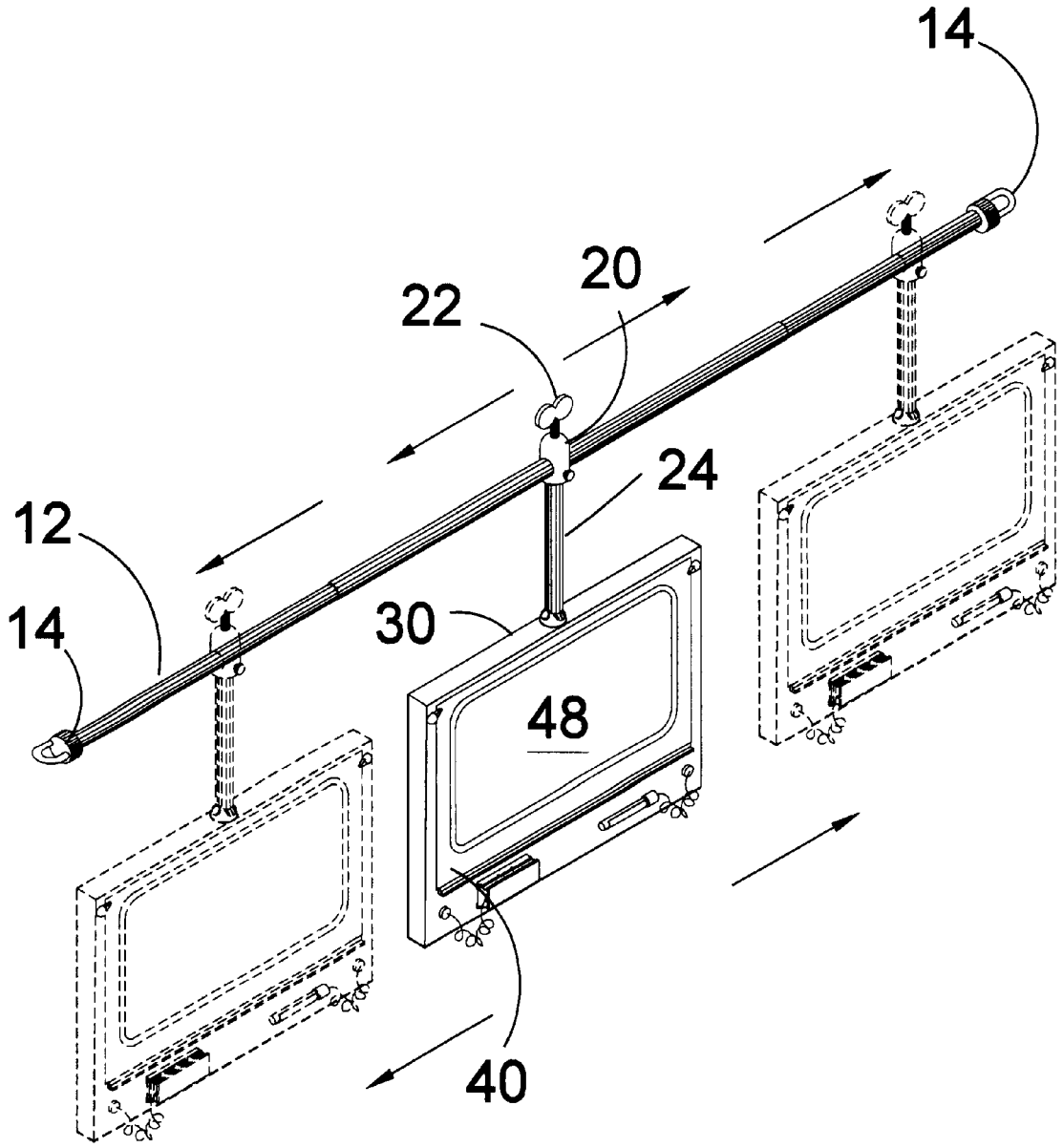
FIG. 3 is a perspective view depicting the adjustment capabilities of the present invention. Shown is the wing nut adjustment nut that allows the activity screen to move left and right on the spring tension extension rod.

In this embodiment, the screen holder 20 is slipped onto the extension rod 12 by removing one of the rod hooks 14 and inserting the extension rod 12 through the screen holder 20. In other embodiments, the screen holder 20 can be clamped directly to extension rod 12 in either embodiment, the screen holder 20 is adjustable along the length of the extension rod 12, as shown in FIG. 3.

Figure 4:
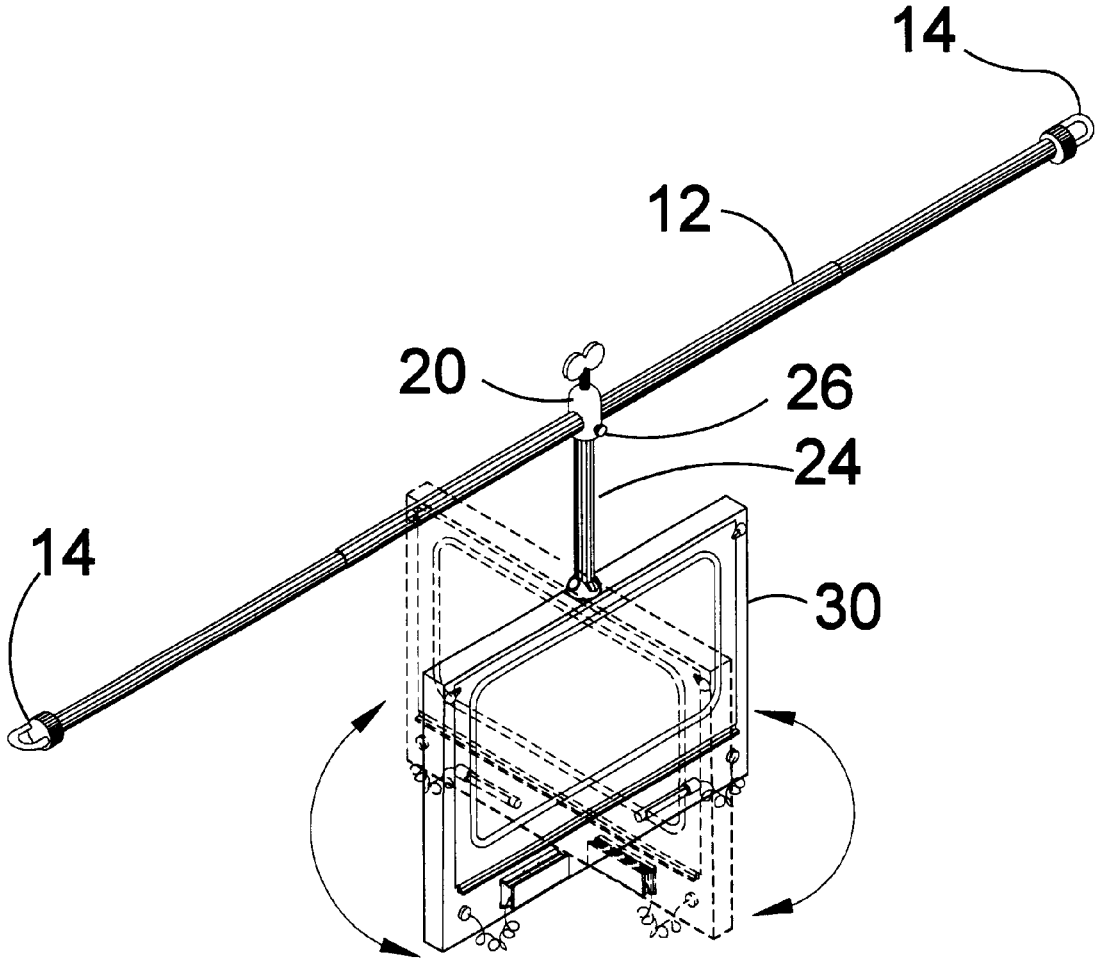
FIG. 4 is a perspective view depicting the angle adjusting knob, which allows the user to adjust the angle of the activity screen to a comfortable position.

Extending from the screen holder 20 is a connection member 24 that rotates within screen holder 20. The rotated position for the connection member 24 is fixed by tightening angle adjustment screw 26. The rotational direction provided by the adjustment is shown in FIG. 4

Figure 7:
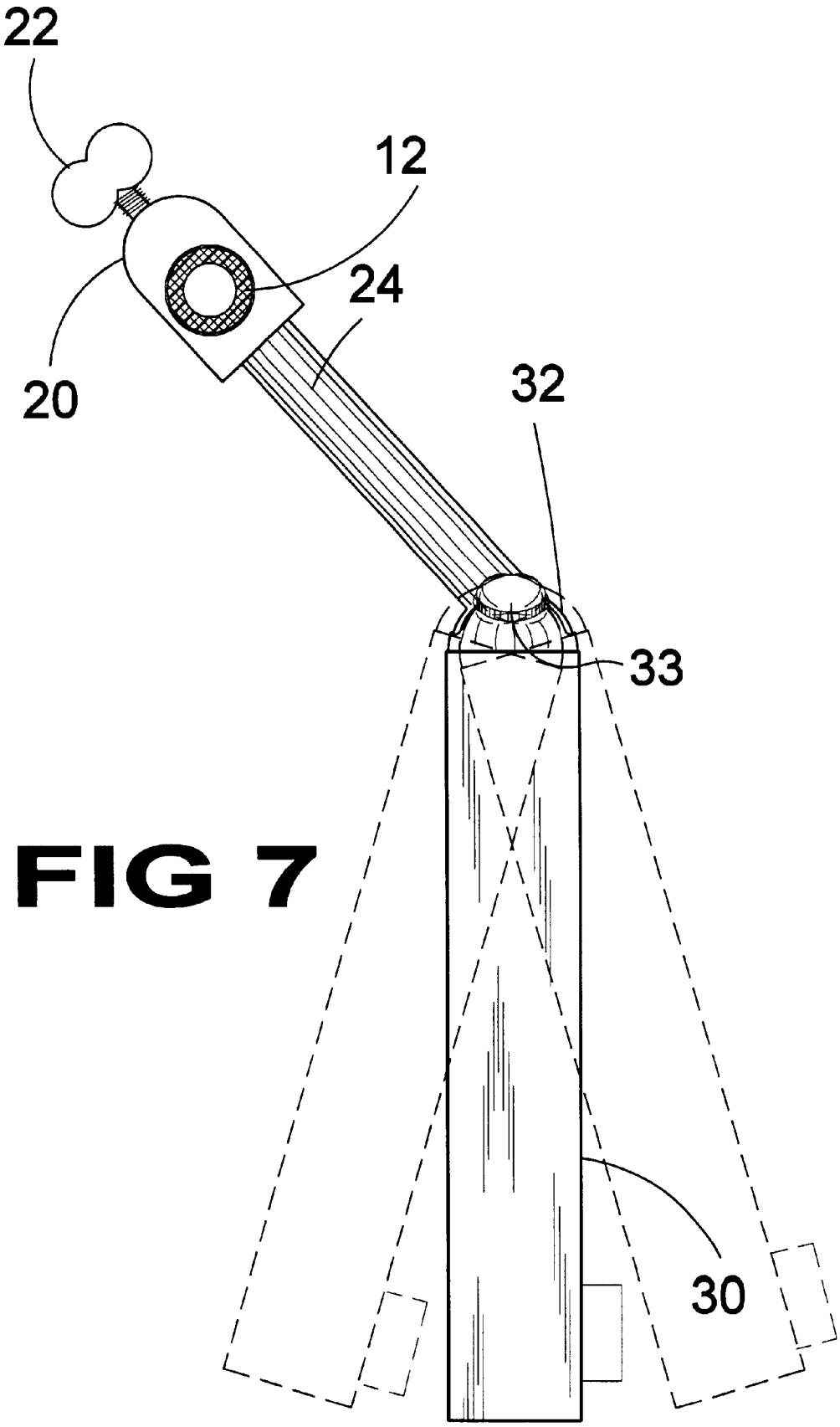
FIG. 7 is a side view of the present invention showing the pivotabilty of the screen due to the ball joint connection with the connection member A locking mechanism maintains the screen when the appropriate tilt is achieved. Two possible screen tilts are shown in hidden line.

An activity screen 30 is pivotally attached to the connection member 24 by a pivoting ball joint 32. In this embodiment, the activity screen 30 pivots on the pivoting ball joint 32 in a single plane that is substantially perpendicular to the longitudinal axis of the extension rod 12. Once the proper position is achieved the activity screen 30 is locked into position on the pivoting ball joint 32 by locking mechanism 33. This rotation is illustrated in FIGS. 6 and 7.

In other embodiments, the pivoting ball joint 32 allows movement of the activity screen 30 in multiple planes.

Figure 11:
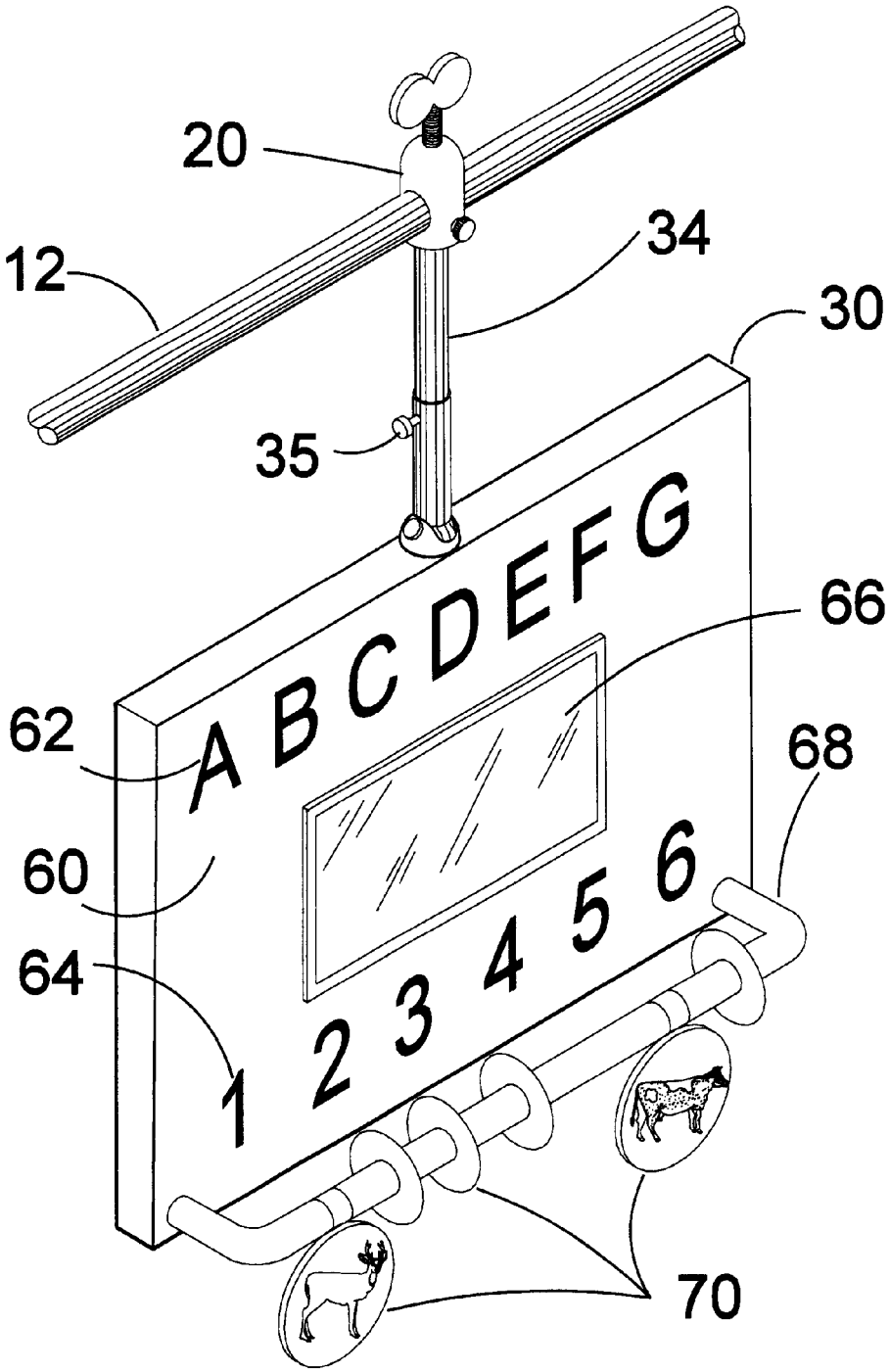
FIG. 11 depicts a telescoping connection member in use on the embodiment of FIG. 10.

In this embodiment, the three-way rotation capability of the screen holder 20, connection member 24, and pivoting ball joint 32, allow the activity screen 30 to be swung fore and aft, rotated side to side, and angled up and down. By proper manipulation of these features, the activity screen 30 can be optimally positioned to the child's satisfaction in other embodiments, a telescoping connection member 34 telescopes and can be secured by tightening connection member set screw 35, as shown in FIG. 11. This adjustment provides additional vertical adjustment capabilities.

Figure 12:
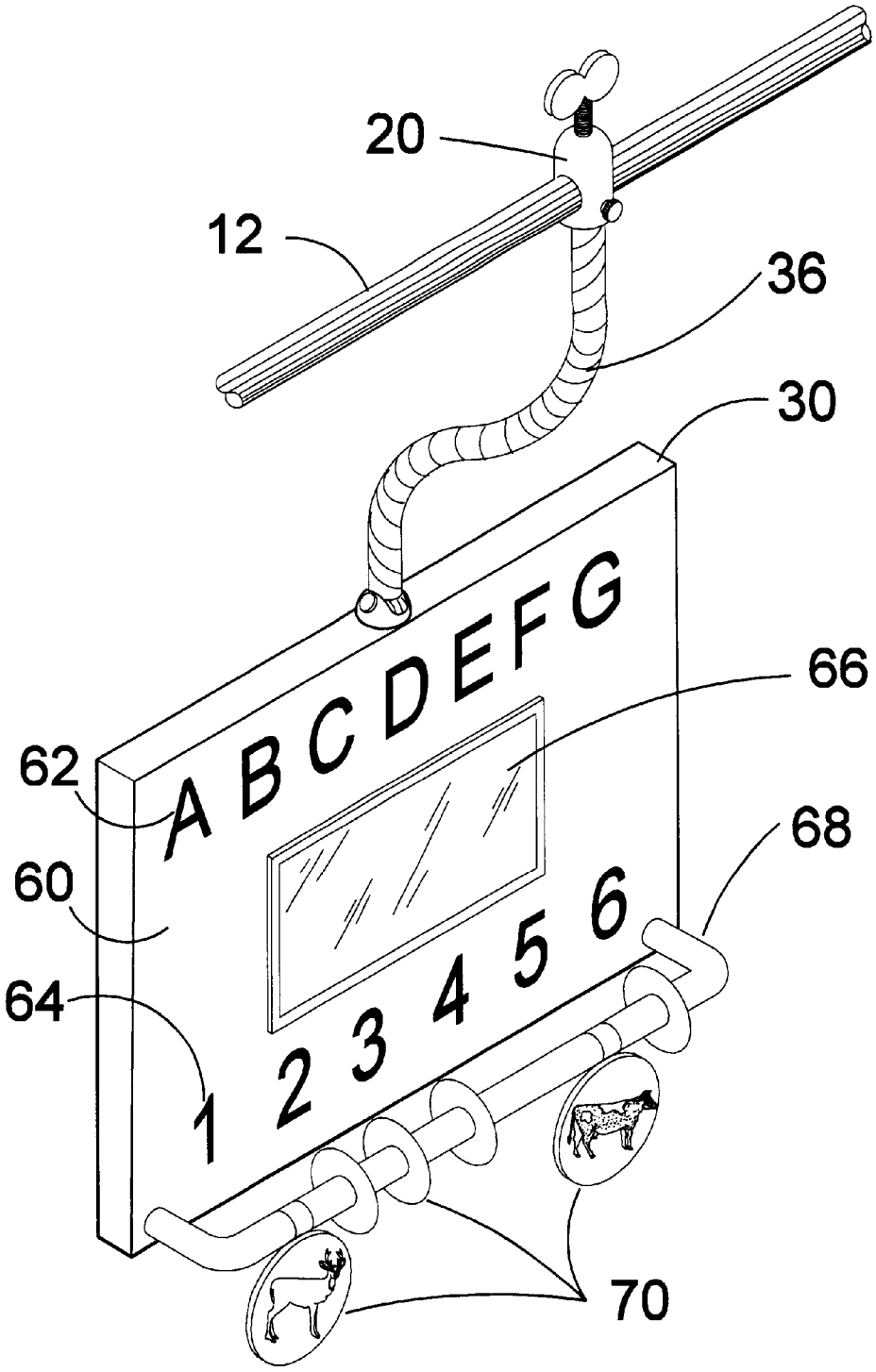
FIG. 12 depicts a flexible connection member in use on the embodiment of FIG. 11.

In yet another embodiment depicted in FIG. 12, a flexible connection member 36 is utilized. The flexible connection member 36 flexes plastically, such that it retains the desired position when manipulated.

Figure 8:
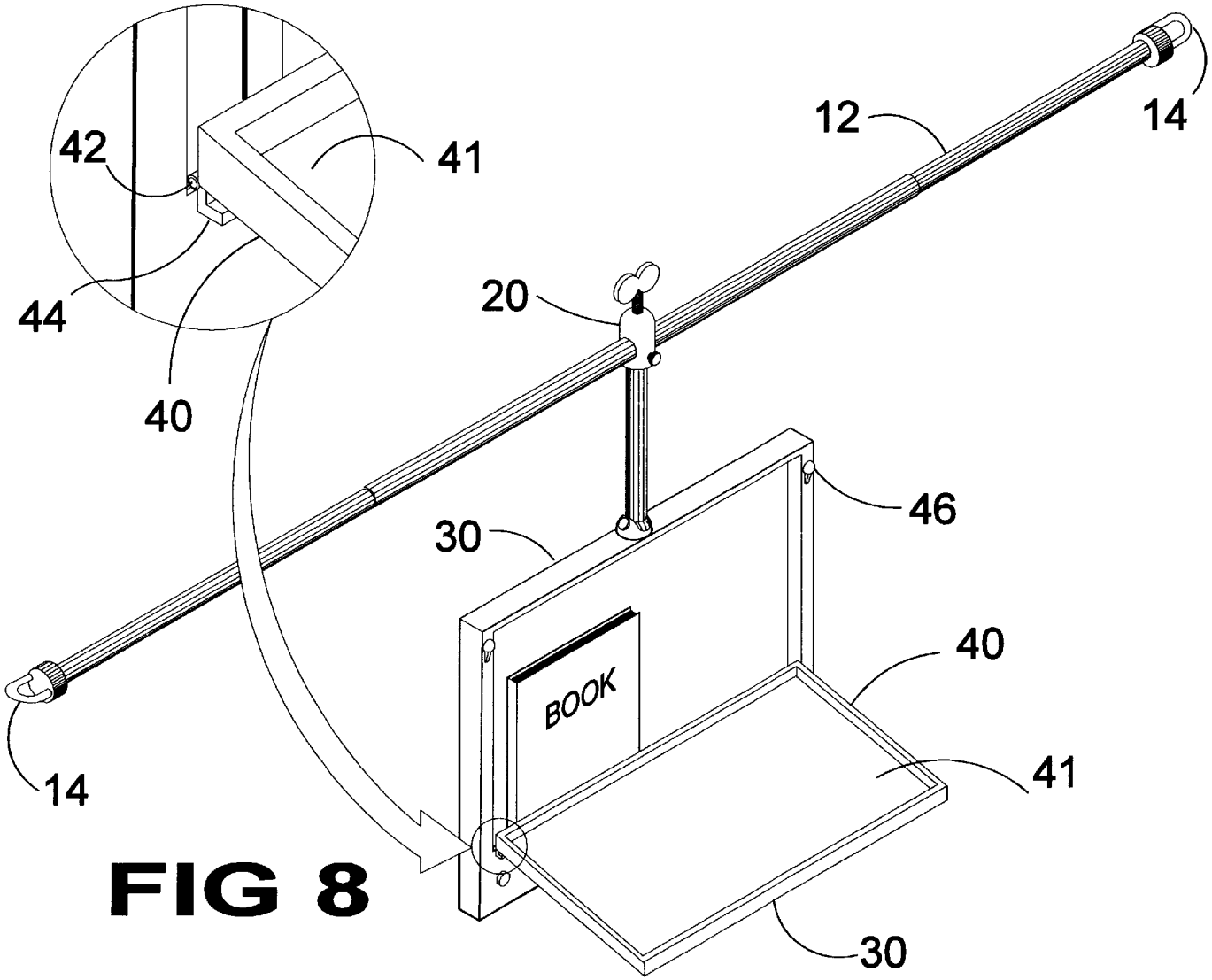
FIG. 8 is a pictorial view of the chalkboard activity screen showing the tray in it down position and the access storage area exposed.
Figure 9:
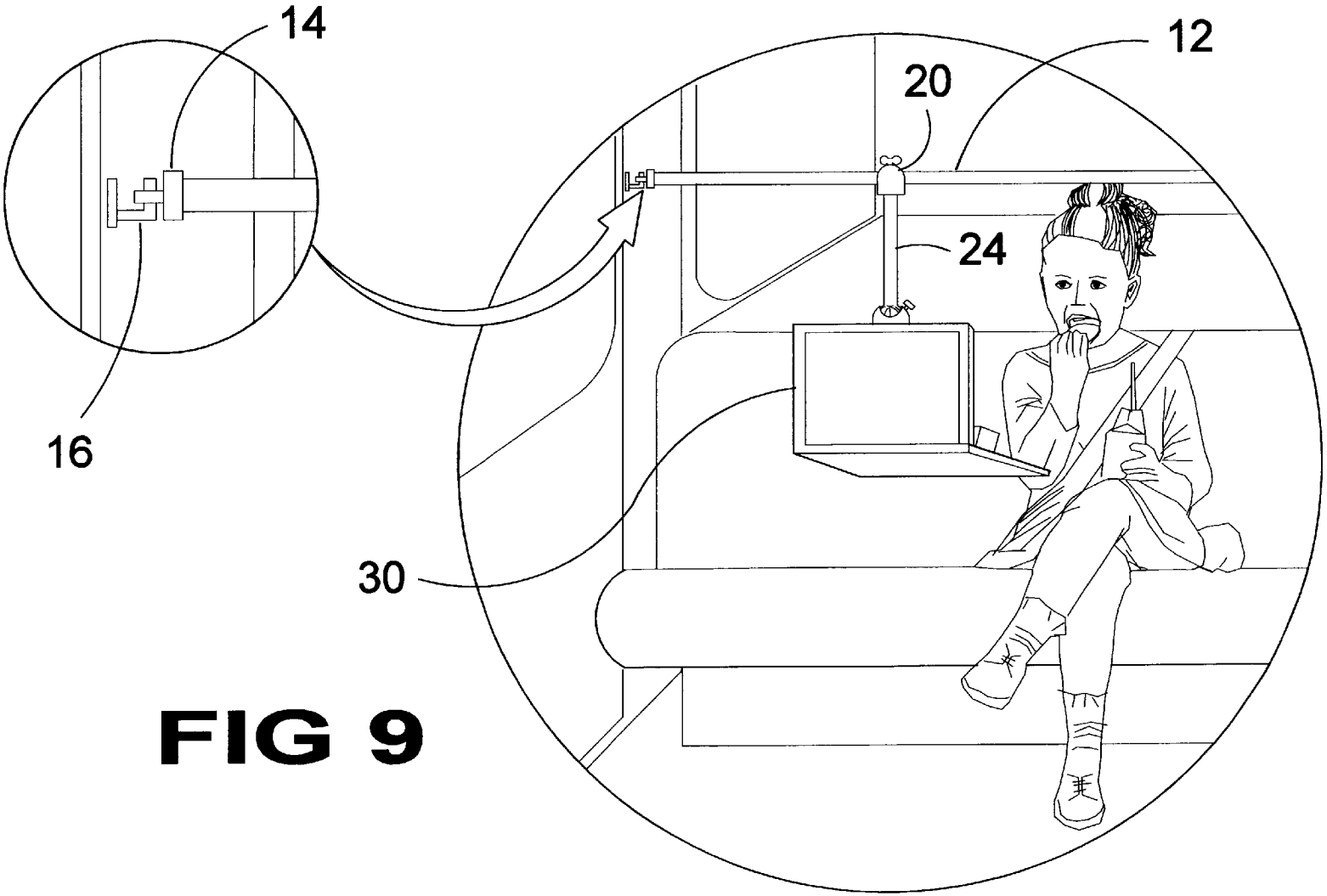
FIG. 9 is a pictorial view of the present invention showing the relationship between the extension rod hooks and the vehicle, garment hooks.

FIG. 8 depicts one embodiment of the activity screen 30, that includes a front portion 40 that is attached to the activity screen 30 by hinge 42. When closed, the front portion 40 is held in place by plastic clips 44. By proper manipulation of the plastic clips 44, the front portion 40 can be lowered on the hinge 42 until it abuts the tray stopper 46. At this point the front portion 40 is substantially horizontal and can serve a number or purposes, such as supporting food or books A front portion recess 41 is useful in this regard. As shown in FIG. 8, the lowered upper portion 40 provides access to interior storage.

Figure 2:
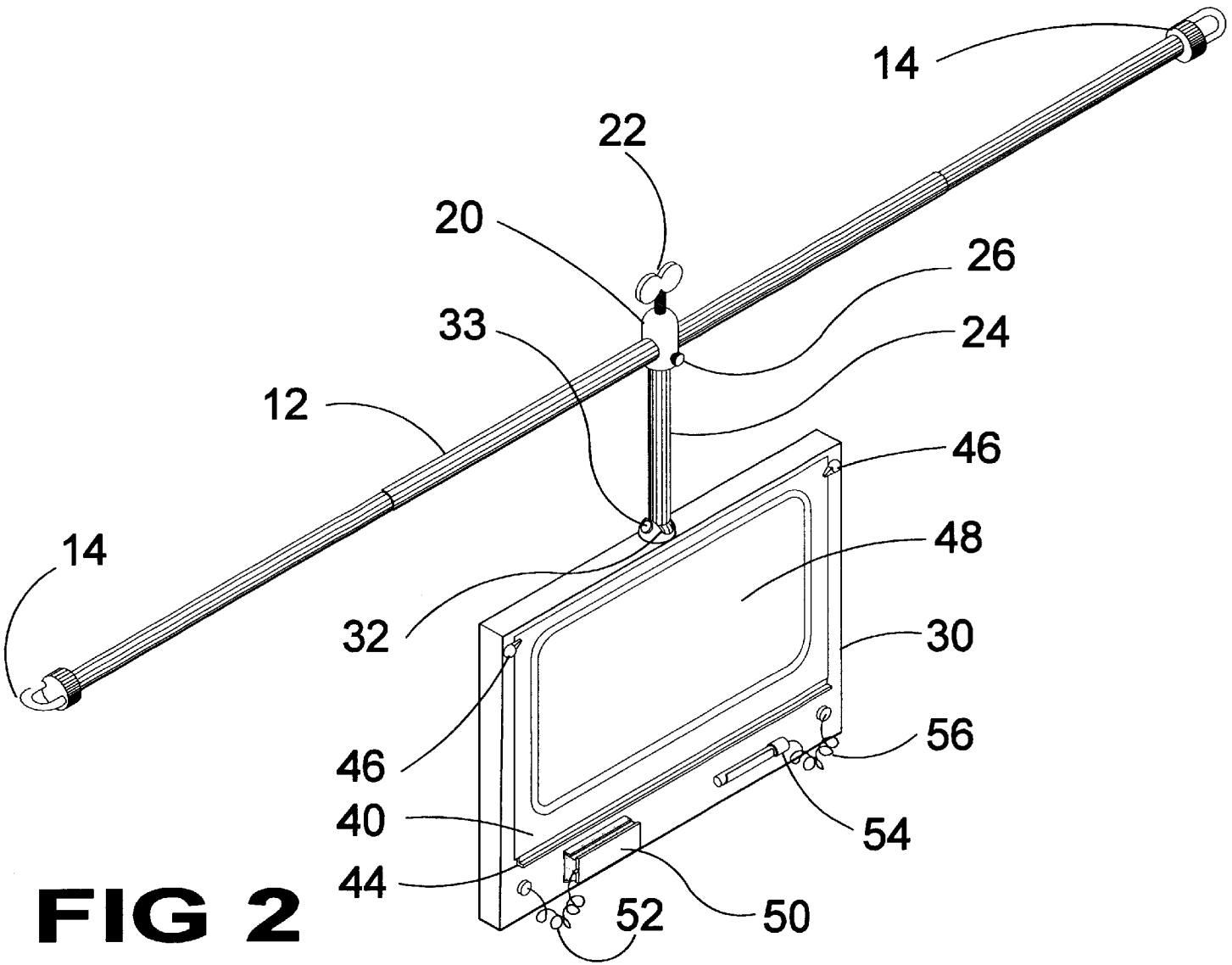
FIG. 2 is a perspective of the present invention. Shown are the external components that comprise the embodiment of the chalkboard activity screen.

A particular embodiment of the activity screen 30 is depicted in FIG. 2. In this embodiment, the front portion 40 displays a chalkboard 48 when the front portion 40 in the closed position. An eraser 50 is attached to the activity screen 30 by eraser string 52. A chalk holder 54 is attached by chalk holder string 56In other embodiments, an easel can be similarly displayed.

Figure 10:
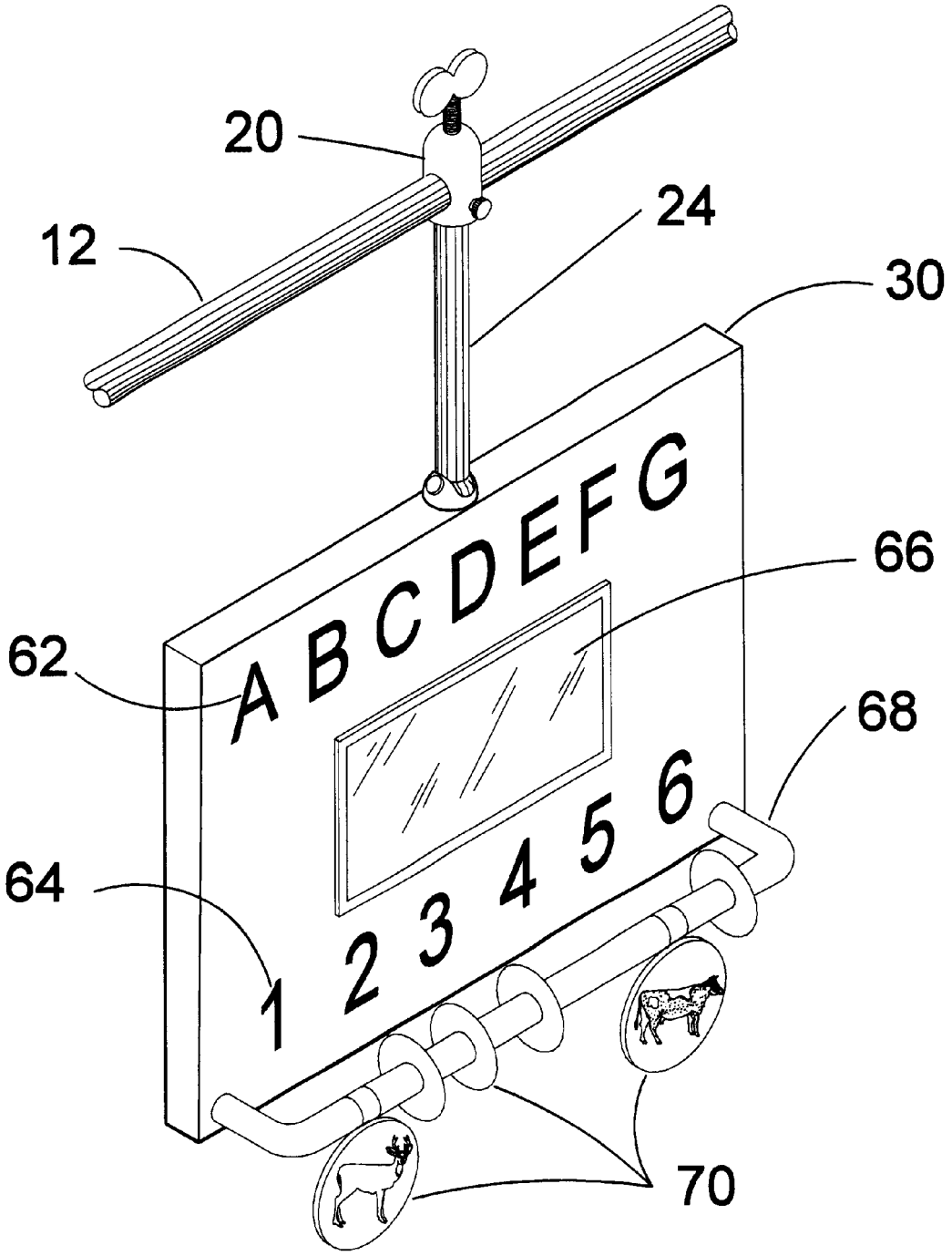
FIG. 10 is a perspective view of a toddler activity screen showing attaching components such as colorful spinners, color letters, color numbers and a mirror and may provide a variety of entertaining parts not illustrated in this pictorial.

FIG. 10 illustrates another embodiment of the activity screen 30. By properly positioning the activity screen 30, a display 60 is presented that can include letters 62, numbers 64, a mirror 66, geometric shapes, cartoon characters, floral shapes, animal shapes, astronomical objects, marine objects, marine characters, military characters, military objects, games, and the like. As shown in FIG. 10, a slide bar 68 is provided with slidable, decorative spinners 70,72. The spinners 70,72 can be mounted by loops 74 or through holes in the spinners. Many other typical children's devices can be displayed, such as rotating knobs, pushable buttons, and the like, all in accordance with the present invention, and as determined by the intended end use for the overall device, as will occur to those of skill in the art upon review of the present disclosure.

In other embodiments, the display 60, and all items, characters, objects, games, and the like, as described above, can be placed an the front portion 40 for viewing and/or utilization while the front portion 40 is in the open, horizontal position. They can be similarly located of the exposed inner surface of the activity center 30 when the front portion 40 is in the open position.

It will be understood that each of the elements described above, or two or more together may also find a useful application in other applications differing from that described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present intention.

Without further analysis, the foregoing will so fully reveal the gist of the present invention that others can, by applying current knowledge, readily adapt it for various applications without omitting features that, from the standpoint of prior an, fairly constitute essential characteristics of the generic or specific aspects of this invention.

What is claimed as new and desired to be protected by Letters Patent is set forth in the appended claims:

1. An activity device for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen comprising a display including numbers and a mirror; and (c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end.

2. The device of claim 1, wherein the activity screen pivots at the connection member second end in multiple planes.

3. The device of claim 1, wherein the screen holder is adapted to be positioned at various points along the length of the rod.

4. The device of claim 1, wherein the connection member telescopes such that the connection member may be shortened or lengthened.

5. The device of claim 1, wherein the display includes letters.

6. The device of claim 1, wherein the display includes geometric shapes.

7. The device of claim 1, wherein the display includes animal shapes.

8. The device of claim 1, wherein the display includes floral shapes.

9. The device of claim 1, wherein the display includes cartoon characters.

10. The device of claim 1, wherein the display includes astronomical objects.

11. The device of claim 1, wherein the display includes marine characters.

12. The device of claim 1, wherein the display includes marine objects.

13. The device of claim 1, wherein the display includes military characters.

14. The device of claim 1, wherein the display includes military objects.

15. The device of claim 1, wherein the display comprises at least one game.

16. An activity device for mounting to a rod of the type which attaches to automobile garment hooks, comprising:

(a) a screen holder, the screen holder being adapted to rotatably grasp the red such that the screen holder may be rotated about the rod's longitudinal axis;

(b) an activity screen comprising a display including numbers and a rotating knob; and (c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end.

17. An activity deuce for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen comprising a display including numbers and a pushable button; and (c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end.

18. An activity device for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen comprising a display including numbers and an easel; and (c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end.

19. An activity device for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen comprising a display including numbers and a chalkboard; and (c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end.

20. The device of claim 19, further comprising an eraser and an attachment string for attaching the eraser to the activity screen.

21. The device of claim 19, further comprising a chalk holder and an attachment string for attaching the chalk holder to the activity screen.

22. The device of claim 19, wherein the chalkboard is hinged for movement to a substantially horizontal position.

23. An activity device for mounting to a red of the type which attaches to automobile garment hooks, comprising:

(a) a screen holder, the screen holder being adapted to rotatably grasp the rod such that the screen holder may be rotated about the rod's longitudinal axis;

(b) an activity screen comprising a display including numbers;

(c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end; and (d) the activity screen further comprises a hinged front portion, the hinged front portion being hingedly movable from a closed position to a substantially horizontal open position, the front portion having a front surface, the activity screen display being positioned on such front surface for access while the front portion is closed.

24. An activity device for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen comprising a display including numbers;

(c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end; and (d) the activity screen further comprises a hinged front portion, the hinged front portion being hingedly movable from a closed position to a substantially horizontal open position, the front portion having a rear surface, the activity screen display being positioned on such rear surface for access while the front portion is open.

25. An activity device for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen comprising a display including numbers;

(c) a connection member, the connection member having a first end, the first end being rotatably fastened to the screen holder, such that the connection member can be rotated about the connection member's longitudinal axis, the connection member further having a second end, the activity screen being pivotally fastened to the connector member second end, such that the activity screen can be pivoted about the connection member second end; and (d)activity screen further comprises a hinged front portion, the hinged front portion being hingedly movable from a closed position to a substantially horizontal open position, the activity screen further having an interior surface, the interior surface being exposed when the front portion is in the open position, the activity screen display being positioned on such interior surface.

26. An activity device for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen;

(c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end; and (d) the activity screen further comprises a hinged front portion, the hinged front portion being hingedly movable from a closed position to a substantially horizontal open position.

27. The device of claim 26, further comprising a storage compartment, the storage compartment being accessible by lowering the activity center front portion.

28. The device of claim 26, wherein the hinged portion has a rear surface, the rear surface facing generally upwards when the hinged portion is in the open position.

29. The device of claim 28, further comprising a recess in the hinged portion rear surface.

30. An activity device for mounting to a rod of the type which attaches to automobile garment hooks, comprising:

(a) a screen holder, the screen holder being adapted to rotatably grasp the rod such that the screen holder may be rotated about the rod's longitudinal axis;

(b) an activity screen;

(c) a connection member, the connection member having a first end, the first end being rotatably fastened to the screen holder, such that the connection member can be rotated about the connection member's longitudinal axis, the connection member further having a second end, the activity screen being pivotally fastened to the connection member second end, such that the activity screen can be pivoted about the connection member second end; and (d) a slide bar, the slide bar being attached to the activity center, the slide bar further comprising at least one slidable members, the slidable members being movable along the slide bar and rotatable along the slide bar.

* * * * *